US007188714B1

(12) United States Patent
Herold

(10) Patent No.: US 7,188,714 B1
(45) Date of Patent: Mar. 13, 2007

(54) TRAVEL BAG WITH INTEGRATED SUPPORT

(75) Inventor: Jeffrey C. Herold, Huntington Beach, CA (US)

(73) Assignee: West Coast Trends, Inc., Huntington Beach, CA (US)

( * ) Notice: Subject to any disclaimer, the term of this patent is extended or adjusted under 35 U.S.C. 154(b) by 87 days.

(21) Appl. No.: 10/678,992

(22) Filed: Oct. 2, 2003

Related U.S. Application Data

(63) Continuation of application No. 08/847,554, filed on Apr. 24, 1997, now abandoned.

(51) Int. Cl.
*A45C 5/14* (2006.01)
*A45C 13/30* (2006.01)

(52) U.S. Cl. ..... 190/18 A; 190/18 R; 190/39; 190/115; 190/126; 190/127; 190/893; 280/47.26; 383/97

(58) Field of Classification Search ..... 190/18 A, 190/39, 115, 117, 125–127, 903, 111; 280/47.26; 150/117; 282/97, 907; 383/97, 907
See application file for complete search history.

(56) References Cited

U.S. PATENT DOCUMENTS

| | | | | |
|---|---|---|---|---|
| 1,325,692 | A | 12/1919 | Cross | |
| 1,555,772 | A | 9/1925 | Stripe | |
| 1,859,970 | A | 5/1932 | Kaufmann | |
| 2,466,160 | A | 4/1949 | Deorrlamm | |
| 2,602,676 | A | 7/1952 | Fieldhouse | |
| 2,627,952 | A * | 2/1953 | Korchmar | 190/109 |
| 2,718,251 | A | 9/1955 | Barbato | |
| 2,868,559 | A | 1/1959 | Vincelette | |
| 3,019,952 | A * | 2/1962 | Brewster | 294/142 |
| 3,125,854 | A | 3/1964 | Skowron, Sr. | |
| 3,128,854 | A | 4/1964 | Specht | |
| 3,158,299 | A | 11/1964 | Wier et al. | |
| 3,316,951 | A | 5/1967 | Jacobson | |
| 3,418,005 | A | 12/1968 | Allina | |
| 3,471,163 | A | 10/1969 | Swara | |
| 3,693,849 | A | 9/1972 | Knabenbauer | |
| 3,985,171 | A | 10/1976 | Summers et al. | |
| 3,998,304 | A | 12/1976 | Edgerton, Jr. et al. | |
| 4,059,464 | A | 11/1977 | Geller et al. | 312/244 |
| 4,301,849 | A | 11/1981 | Litwack et al. | |
| D280,362 | S | 9/1985 | Allen | |
| 4,596,397 | A | 6/1986 | Conti | 280/47.13 |
| 4,657,135 | A | 4/1987 | Kjose | 206/315.3 |
| 4,729,460 | A | 3/1988 | Kim | 190/109 |
| 4,752,004 | A | 6/1988 | Very | 206/315.4 |
| D296,955 | S | 8/1988 | Janney et al. | |

(Continued)

FOREIGN PATENT DOCUMENTS

| | | |
|---|---|---|
| DE | 3400956 | 7/1985 |

(Continued)

*Primary Examiner*—Sue A. Weaver

(57) ABSTRACT

A travel bag includes two major components; specifically, a bag member and a base member. These components are formed to matingly fit together and to be permanently attached to one another via rivets. The bag member incorporates additional features including a reinforcement system of webbing with longitudinal and circumferal portions. Also, the bag includes accessory pockets, a taper and padding, zippered opening, 'D'-ring, among others. The base member features include wheels, reinforcement ribbing, seamless and cornerless joints, surface relief indicia among others. In addition, the travel bag as a whole enjoys a new arrangement of all parts and systems which provides for an extremely durable and rugged device.

54 Claims, 3 Drawing Sheets

U.S. PATENT DOCUMENTS

| | | | | |
|---|---|---|---|---|
| 4,792,152 | A | | 12/1988 | Carolan ..... 280/47.26 |
| 4,905,827 | A | | 3/1990 | Kim ..... 206/315.3 |
| 4,911,465 | A | | 3/1990 | Hauer ..... 206/315.6 |
| 4,934,573 | A | | 6/1990 | Jaeger ..... 224/153 |
| 4,953,768 | A | | 9/1990 | Muse |
| 5,033,759 | A | | 7/1991 | Wix ..... 280/47.18 |
| 5,071,147 | A | | 12/1991 | Stansbury ..... 206/315.6 |
| 5,105,919 | A | | 4/1992 | Bomes et al. |
| 5,109,961 | A | | 5/1992 | Bergman ..... 190/18 A |
| 5,112,068 | A | | 5/1992 | Liao et al. ..... 206/315.3 |
| 5,215,318 | A | | 6/1993 | Capraro ..... 280/47.26 |
| 5,244,219 | A | | 9/1993 | Hadlum ..... 280/47.26 |
| 5,265,894 | A | | 11/1993 | Dunn ..... 150/159 |
| 5,289,906 | A | | 3/1994 | Guidi ..... 190/107 |
| 5,295,565 | A | | 3/1994 | Latshaw ..... 190/18 A |
| 5,307,908 | A | | 5/1994 | Shyr et al. ..... 190/18 A |
| 5,374,073 | A | | 12/1994 | Hung-Hsin |
| 5,383,505 | A | | 1/1995 | Corasco, Jr. ..... 206/315.4 |
| 5,431,262 | A | | 7/1995 | Rekuc et al. ..... 190/18 A |
| 5,443,156 | A | | 8/1995 | Shioda ..... 206/315.4 |
| 5,447,261 | A | | 9/1995 | Mitomi et al. ..... 190/18 A |
| 5,456,342 | A | | 10/1995 | Rekuc et al. ..... 190/18 A |
| 5,470,095 | A | | 11/1995 | Bridges ..... 280/646 |
| 5,498,010 | A | | 3/1996 | Stube ..... 190/18 A |
| 5,515,897 | A | | 5/1996 | Fehan ..... 150/159 |
| 5,524,737 | A | | 6/1996 | Wang ..... 190/18 A |
| 5,547,052 | A | * | 8/1996 | Latshaw ..... 190/108 |
| 5,575,362 | A | | 11/1996 | Franklin et al. ..... 190/115 |
| 5,632,496 | A | | 5/1997 | Nelson ..... 206/315.3 |
| 5,634,576 | A | | 6/1997 | Arbel ..... 224/153 |
| 5,743,363 | A | | 4/1998 | Rekuc et al. |
| 5,743,447 | A | | 4/1998 | McDermott ..... 224/153 |
| 5,749,503 | A | | 5/1998 | Wulf et al. ..... 224/153 |
| 5,873,504 | A | * | 2/1999 | Farmer ..... 224/576 |
| 6,068,271 | A | | 5/2000 | Lustica ..... 280/47.26 |

FOREIGN PATENT DOCUMENTS

| | | |
|---|---|---|
| FR | 2590458 | 5/1987 |
| JP | 621 78 26 | 8/1994 |

* cited by examiner

TRAVEL BAG WITH INTEGRATED SUPPORT

CROSS-REFERENCE TO RELATED APPLICATION

This application is a continuation and claims priority based on parent application Ser. No. 08/847,554, entitled "Travel Bag with Integrated Support" by Jeffrey C. Herold, filed on Apr. 24, 1997, abandoned.

BACKGROUND OF THE INVENTION

1. Field

This invention is generally concerned with luggage materials, configurations and designs, and is specifically concerned with travel bags having specialized support integrated therewith to provide a strong base which is resistant to wear and damage occasioned by use of said bag.

2. Prior Art

The frequent traveler is well aware of need for high quality travel bags. Transit systems tend to be quite taxing on baggage of low quality. Bags get stuck, torn, ripped or snagged on equipment such as doors, escalators, conveyors, carts, handrails, armrests, among others. As travel bags tend to be heavy when loaded, they may be equipped with wheels to facilitate transport across smooth floors. Wheels are typically mounted into the bottom of such bags. An additional feature may include a handle. Handles are sometimes retractable into the bag such that the bag occupies a smaller space and allows for convenient storage.

Some bags are designed for very heavy loads. Commonly known as "duffel" bags, a flexible material forms an enclosure into which objects may be packed. For example, a bag designed to carry sporting equipment may be made of strong canvas and reinforced at the seams with webbing or alternative durable materials. These bags may be particularly suited for carrying large and bulky objects which cause increased wear on the bags.

An example of a travel bag suited for sporting equipment is taught by Mr. Kjose in U.S. Pat. No. 4,657,135. The bag is designed to carry a second containment vessel of similar shape. It is shown with wheels attached about its bottom at various locations. Additionally, it has a zip opening and a handle. With the wheels distributed as shown, i.e. with a long wheelbase, the bag tends to be difficult to steer. In addition, the lower corners of the bag tend to be exposed. They may be engaged by or come into contact with many objects which may cause wear to them.

An enclosure for sporting equipment is described in detail in U.S. Pat. No. 4,953,768 by inventor Muse. The enclosure is particularly designed to protect its contents against the elements and specifically rain. The cover may similarly be equipped with a handle which cooperates with the cover to which it is attached.

Mr. Hauer of Washington teaches a wheeled bag in the form of a cart with a handle and accessory holder in U.S. Pat. No. 4,911,465. The two wheels are spread such that they are broader than the bag is in order to resist tipping in a lateral direction.

Finally, Mr. Dunn of Santa Anna, Calif. teaches a novel bag in which a golf club set is to be carried. U.S. Pat. No. 5,265,894 shows a bag which includes wheels and a handle. Of particular interest is the bottom member which is a rigid element. The sides of the bag are fastened to the bottom member which supports the wheels.

Perhaps the most sophisticated experts with regard to travel bags include airline personnel. Travelers will certainly recall that flight attendants and pilots often tote a wheeled bag through airport and hotel lobbies. The bag is typically made of durable canvas or similar cloth material. With a retractable handle, the bag is pulled behind the user while the bottom is supported on two wheels in contact with the floor. The wheels are preferably quite small and are sometimes built into the bag at wheel wells which are riveted to the canvas bottom. These bags are conveniently designed to fit the compartments of airplanes. They are durable in design, but tend to support a load of only a few tens of pounds. As such, the material used to form the bags is generally only mildly resistant to high friction loads. The corners of these bags are generally made of soft materials which tends to get caught on various objects including sharp metallic objects such as those of which a conveyor might be comprised. The metallic objects tend to tear and destroy the bags. Additionally, the wheels are sometimes subject to very high impact force and may easily break away from the canvas bag to which they are attached. These travel bags may be dragged up or down stairs. Designers have included ribs made of plastic which run in a longitudinal direction down the back of the bag. These ribs may help allow the bag to be dragged over a bumpy surface such as stairs. However, the ribs are usually attached to the soft material of the bag by rivets or adhesives. Objects may operate to tear the ribs from the bag when they engage the ends of the ribs.

Most travel luggage can be classified either "soft" luggage or "hard" luggage. Soft luggage is lightweight and more easily made compact for storage; while hard luggage tends to be more bulky. However, hard luggage is quite strong and may stand up to extreme conditions which act to wear or damage the luggage. Soft luggage is more easily destroyed by conditions to which it may be exposed in normal use. It would be desirable to provide luggage which benefits from the advantages offered by each of these types of luggage, without having the problems associated with either.

Applicants copending application having a Ser. No. 08/734,254 discloses a travel bag which addresses and solves most of the problems mentioned above, among others. The following disclosure relates to the previous, and details additional features and improvements. Therefore, the entire disclosure of the above-identified application is hereby incorporated into this document.

Notwithstanding, new configurations have been discovered which provide novel designs and forms for travel bags, particularly travel bags subject to high wear and damage due to the heavy loads which they support. In contrast to the good and useful inventions mentioned, each having certain features that are no less than remarkable, the instant invention is concerned with providing a long lasting, wear resistant travel bag for heavy loads.

SUMMARY OF THE INVENTION

Comes now, Jeffrey C. Herold with an invention of a travel bag including combinations of materials and configurations arranged to provide a superior travel bag which is highly resistant to damage due to impact and friction forces incident thereon, yet is lightweight and easily made compact for storage.

Features of the invention are directed to improvements in travel bags. In particular, problems and defects which accompany other travel bags are addressed in novel and useful ways. Travel bags of the invention include a combination of two primary parts. An enclosure formed of durable flexible material is joined to a base member which forms a rigid protective function as well as providing wheels for rolling transport.

The enclosure portion may be tapered at the top and augmented with padding to provide a special securing means for items contained in the enclosure. The enclosure portion additionally incorporates a special system of reinforcement webbing. The webbing is arranged in a particular way to provide strength in several important areas. Handles which cooperate with the webbing improve handling properties while reducing the likelihood of damage due to tearing away. Special accessory pockets are fashioned without causing excess bulk or balance problems. A 'D'-ring is disposed at the top of the bag to provide for things which may be affixed or clipped thereto.

The base member is formed from a single piece flat stock which is shaped into a partially enclosed cavity. The shape is a special configuration without edges or seams. The base may include reinforcement ribs formed directly into the material without need of fasteners like screws or adhesives. Wheel wells may be formed into the base member to accommodate ruggedized wheels such as those used for in-line skates. The base may additionally provide for a pad on which the bag sets while in a standing position. The material from which the base is formed supports indicia being formed as a surface relief pattern without need to apply or affixed additional materials thereto. All of these features are accommodated by the complex shape taken by the single piece base member thereby reducing manufacturing costs.

Accordingly, a travel bag comprising a base member; and a bag member, the base member being formed of rigid material to comprise a bottom, back and side portions each joined to the other to form a partially enclosed space operable to receive therein, the bag member being formed of flexible durable material to comprise a top, bottom and body section, the body section being formed of a single piece of material having two mating edges, the material arranged about a longitudinal axis one mating edge of the single piece of material being joined to the second edge to form a generally cylindrical shape having a taper at one end, the top being arranged in a plane substantially perpendicular to a cylinder axis further being affixed to the body, the bottom similarly being arranged in a plane substantially perpendicular to the cylinder axis being affixed to the body to form an enclosure, said bag member being affixed to said base member, is provided.

A first objective of travel bags of the invention is to relieve problems which occur due in part to over-stuffing of travel bags. Large and bulky loads tend to break seams and cause bags to burst resulting in catastrophic failure of the bag. The main body portion bags of the invention are specially formed of a uniform single piece construction thereby eliminating longitudinal seams. Travel bags of the invention may therefore be stuffed with far more load than travel bags having longitudinal seams.

Another primary feature of the invention is a reinforcement system designed in view of particular loads and forces which may act against the bag. Reinforcing webbing material is provided both laterally and longitudinally in a configuration which cooperates with the objectives and features of the travel bags. In particular, two longitudinal front, two longitudinal back and a plurality of circumferal webbing reinforcements comprise a system for extreme strength protection. The relationship of the webbing in view of the bag and base is spectacular in that it maximizes the transfer of tension forces to portions which easily withstand them while removing those forces from regions with may be vulnerable.

Still another feature is a handle at the top which cooperates with the webbing to transmit tension forces to the base which is durable against such forces. Similarly, handles at either side of the bag opening cooperate with the longitudinal webbing to transmit forces into strong reinforcing material and away from the bag main body and zipper opening.

Another feature is specially designed pleated pockets. Some travel bags have sewn to their exterior, pockets for accessories such as shoes, et cetera. As shoes tend to become soiled during normal use, it is quite convenient to have a separate compartment for them. Such a pocket however, tends to have seems, corners, and edges, which interfere and otherwise become caught on and snagged upon equipment which may come into contact with the travel bag. Airport baggage conveyors tend to catch a pocket and tear it completely from the bag to which it is sewn. Pockets, being quite bulky, also tend to make a bag out of balance. Pockets of the invention are formed and configured to cooperate with travel bags and with equipment such as airport conveyors which tend to otherwise damage poorly engineered pockets. Pockets of the invention don't have seams which are exposed to the bag's exterior. The pockets are arranged with their extremities sealed under circumferal webbing at both ends, thus protecting the pockets and objects stored therein.

OBJECTIVES OF THE INVENTION

Accordingly, it is a primary object of the invention to provide a heavy duty travel bag.

It is an additional object to provide a travel bag which resists wear commonly occasioned by such bags.

It is an object to provide a travel bag which is easily made compact for storage.

It is additionally an object to provide a bag with a strong base which supports integration of wheels thereon.

It is an object to provide a travel bag with extra support at regions subject to high friction, snag, tear and impact and other contact forces.

It is an object of the invention to provide a travel bag having a long lifetime.

It is further an object to provide a ruggedized bag with features arranged to prevent failure mechanisms which tend to otherwise destroy travel bags.

It is an object of the invention to provide a bag having elements which cooperate together to form a superior bag.

These objectives and others will be readily appreciated in view of the following examples of preferred embodiments. A better understanding can be had with reference to the detailed description and with reference to the appended drawings. These embodiments represent particular ways to realize the invention and are not inclusive of all ways possible. Therefore, there may exist many versions that do not deviate from the spirit and scope of this disclosure as set forth by the claims, but do not appear here as specific examples. It will be appreciated that a great plurality of alternate versions are possible.

BRIEF DESCRIPTION OF THE DRAWING FIGURES

These and other features, aspects, and advantages of the present invention will become better understood with regard to the following description, appended claims and drawings where:

PREFERRED EMBODIMENTS OF THE INVENTION

Travel bags of the invention are particularly characterized by having two primary members which are configured and arranged to cooperate together as a single unit. Accordingly, such travel bags are comprised of a base member and a bag member. The base member is affixed to the bag member at one end to protect the bag, provide support thereto, and provide a support for wheels which aid transporting the travel bag. The base member is formed of a rigid durable material such as hard plastic, while the bag is formed of a flexible material such as Nylon™ Cordura™ fabric. The base and bag members are shaped as complements such that the bag may be matingly received into a partially enclosed cavity formed by the base. The bag may be firmly affixed to the base to form a combination.

A travel bag is therefore comprised of two primary elements: a base and a bag member. The bag member may have additional features which include, among others, webbing reinforcements, handles, accessory pockets, a "D"-ring, indicia, and padding. The base member may have additional features which include, among others, reinforcement ribs, wheel wells, three point stand, indicia, wheels, curved joints, etc.

Figure 1:
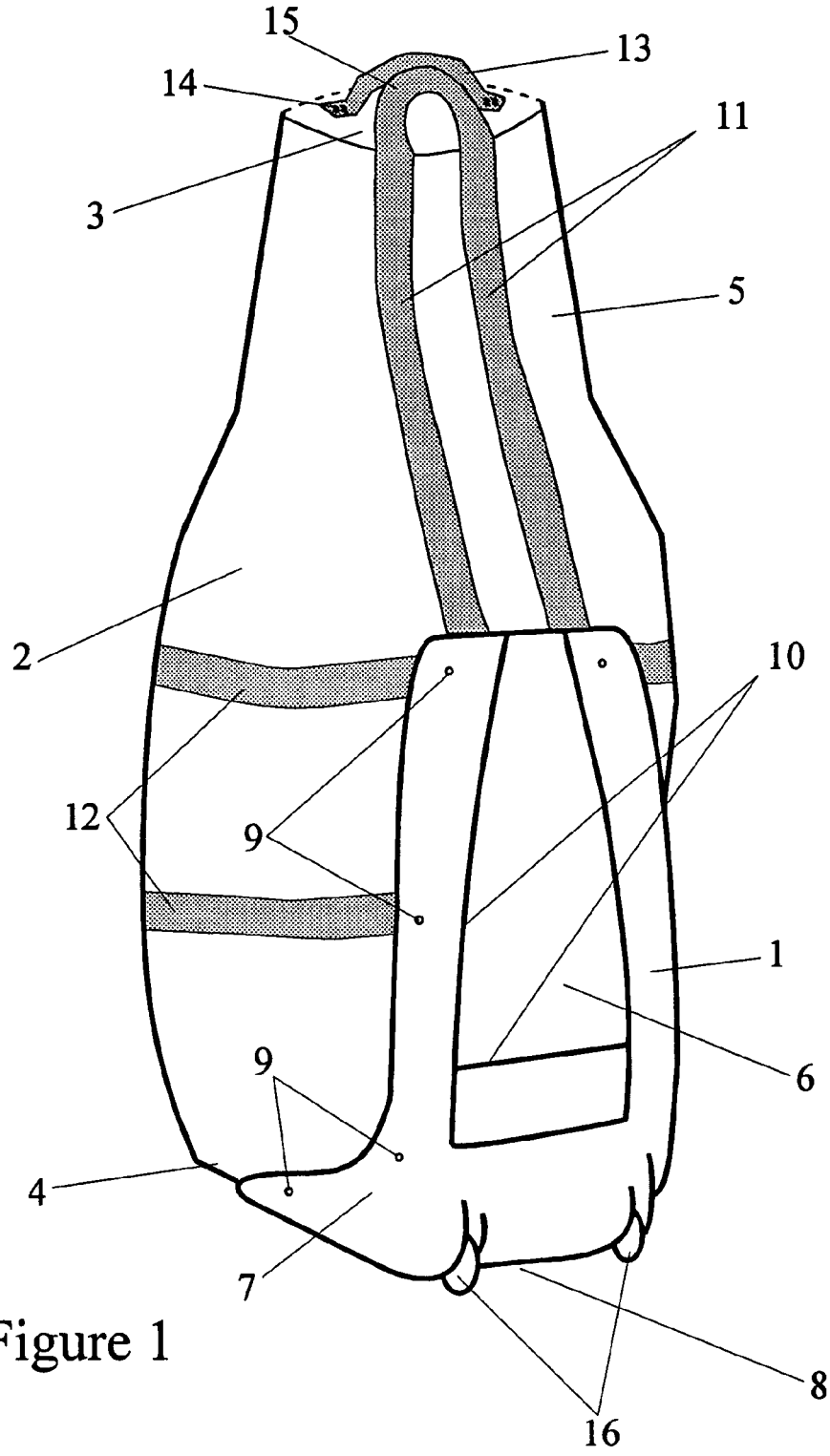
FIG. 1 illustrates a combination of a bag and a base member which form one version of a travel bag of the invention.

With reference to drawing FIG. 1 which shows a back side of a travel bag, one may appreciate a more complete understanding of the invention. A plastic base member 1 is affixed to a bag member 2. The main body of the bag is formed from a single piece of material which has been wrapped about an axis in a substantially cylindrical shape. Perpendicular to the axis, the bag member has a top section 3 and a bottom section 4. The bag may additionally have a tapered portion 5 at the top of the main body. The base 1 forms a partially enclosed cavity. The back portion 6 of the base meets a side portion 7 and a bottom portion 8 at curved joints. Rivets 9 may be used to hold the bag and base members together. To improve strength, the base portion may additionally include reinforcing ribs 10 while the bag may incorporate reinforcing longitudinal webbing 11 and circumferal webbing 12. A handle 13 may be formed and affixed by rivets 14 to the top section of the bag. Two strips of longitudinal webbing on the back of the bag may come together to form a loop 15 which may be grabbed together with the handle. Two wheels 16 may be coupled to the bottom of the base member as shown.

Figure 2:
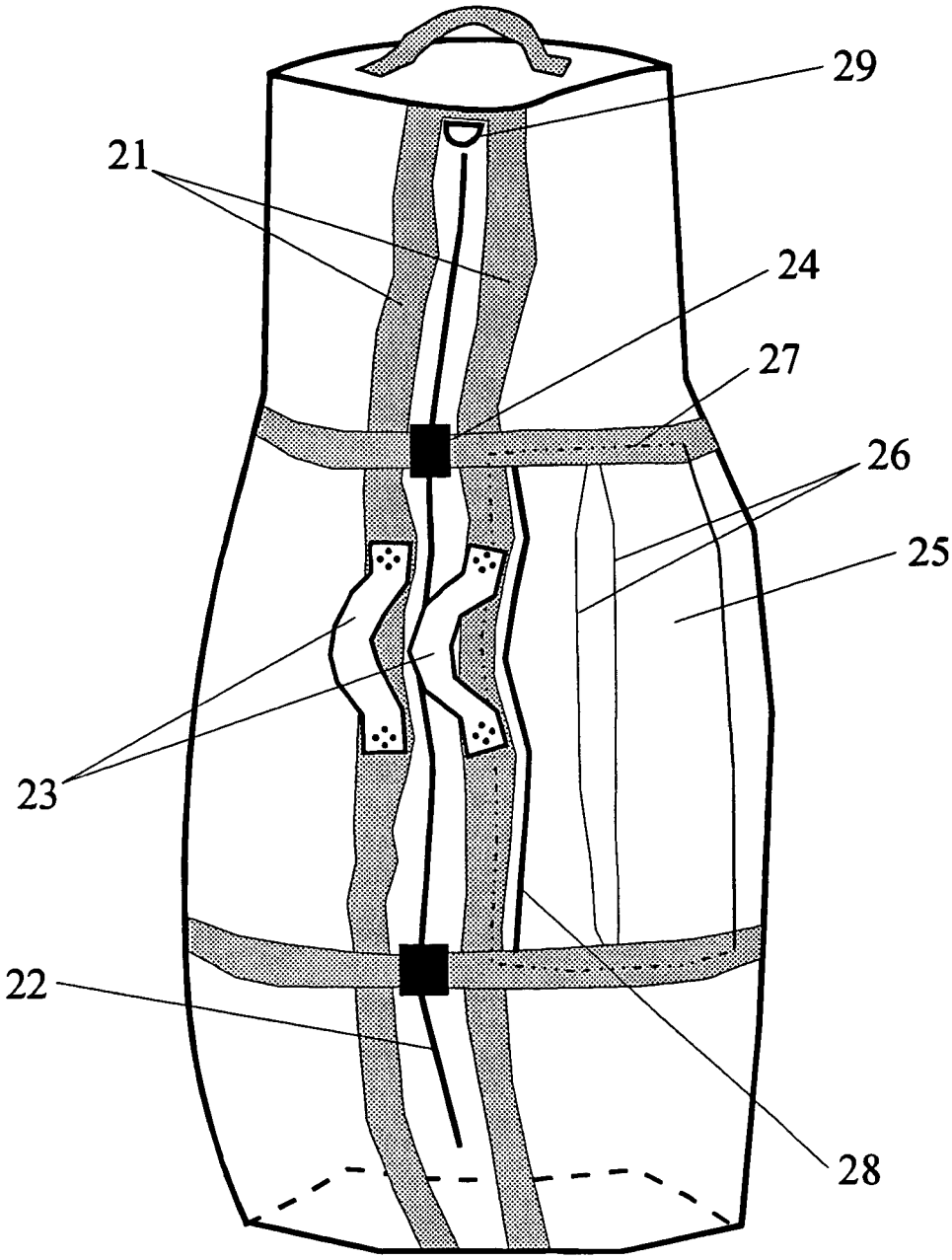
FIG. 2 shows a front side view of a travel bag of the invention.

FIG. 2 is a diagram which shows how the front side of a travel bag of the invention may look. Two strips of longitudinal webbing 21 may run down the body portion from the top section to the bottom section on either side of a zipper opening 22. Two handles 23 may be affixed to the webbing as shown. A strip of circumferal webbing may form a complete or closed loop and be fastened at two piece buckle 24. A rectangular accessory pocket 25 may be formed of a single layer of material having a pleated 26 arrangement. The pocket may have three of its edges 27 held flush to the surface of the body portion of the bag under longitudinal and circumferal webbing. Additionally, the pocket may have a zippered opening 28 which is arranged in close proximity to the longitudinal webbing for strength. Finally, a "D"-ring 29 accessory may be attached to the top section of the bag.

Figure 3:
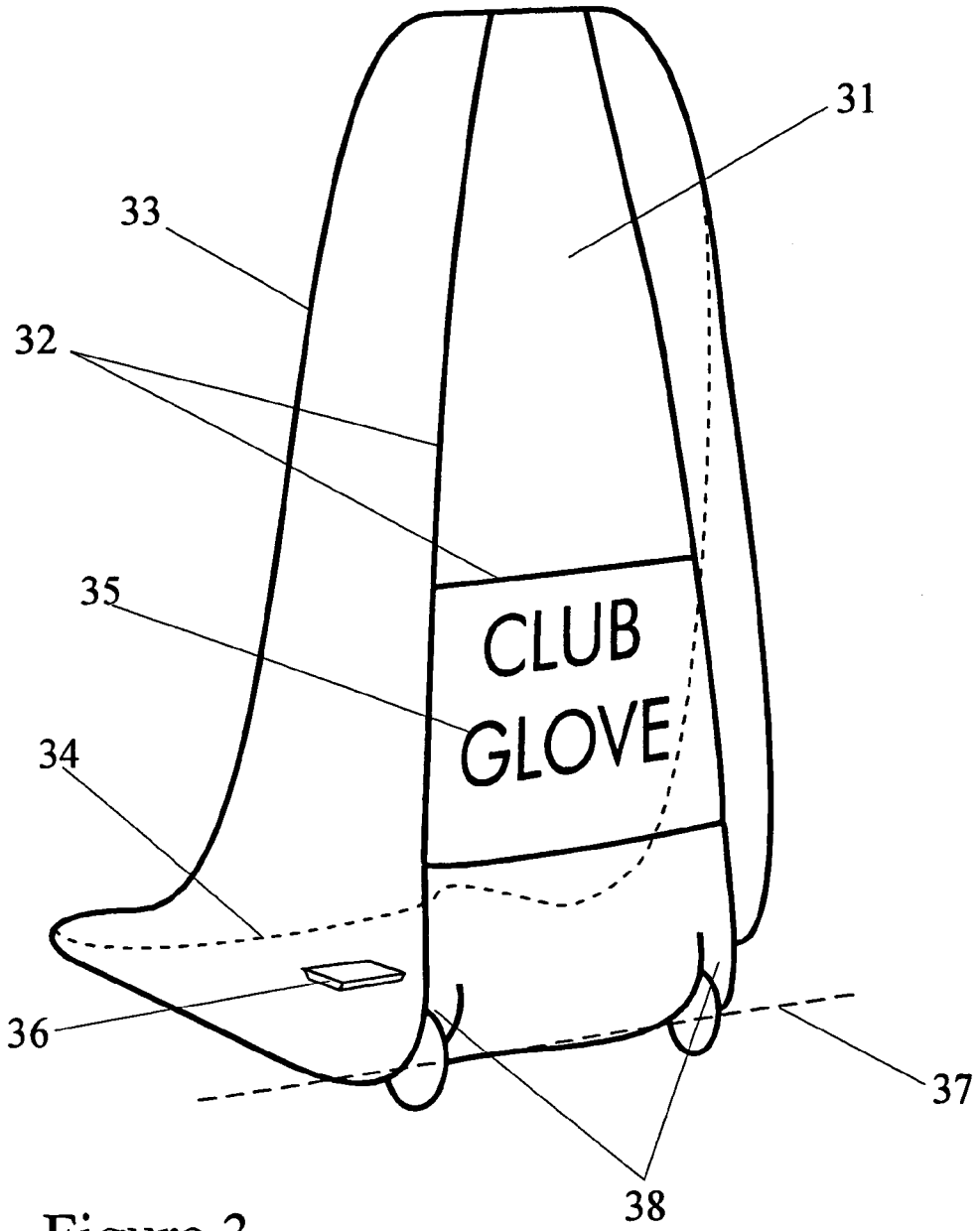
FIG. 3 is a detailed drawing of a base element of the invention.

FIG. 3 shows a perspective view of a base member 31 in detail before it is attached to a bag. Reinforcement ribs 32 may extend both longitudinally and laterally to add strength against flexing. The periphery of the base member is defined by a lip 33 which is continuous and without corners. The figure illustrates a hidden line 34 (broken) to further detail the peripheral lip. Indicia 35 may be formed in surface relief pattern. A pad element 36 disposed on the bottom of the base element forms part of a three point stand. A transverse axis 37 along the joint between the base back and bottom provides alignment for wheels which may be coupled and set into wheel wells 38.

The base member may be described further in detail as follows. It may be formed in a molding process with a single flat sheet of high impact resistant plastic for example. The material is preferably easily drilled to accommodate rivet type fasteners. The sheet, between approximately ⅛ inches and ¼ inches in thickness is shaped while heated. Sometimes called "thermoform", the shaping process allows a complex shape to be realized from a simple extruded plastic source material. The complex shape easily supports many features important to the function of bags of the invention, some of which include: seamless joints; reinforcement ribs; wheel wells; bag standing pad; relief pattern indicia; among others.

Because corners and seams tend to become damaged as a result of stresses which may be incident thereon, it is useful to provide a base member which takes a form without seams and corners. Accordingly, the back, bottom and side portions of the base member blend smoothly into one another by way of gently curved joints. The plastic material from which the base is made is bent to form the joint which may have a minimum radius of about 2 centimeters at any curve. In this way, a nice transition is formed which allows the base to be free from corners and seems.

Reinforcement ribs which run across both or either the length and width of the three portions, the back, bottom and or sides may be integrally formed into the plastic. A simple ridge rising above the surface of the plastic blank material from which the base is made forms a reinforcement rib. Ribs so formed give strength to the base member against bending. For example, the back portion lies substantially in a single plane. By pulling at two opposing edges while pushing in the middle, one tends to bend the piece out of its natural plane. However, ribs formed into the section as described tend to resist such bending and increase the overall strength of the piece.

Reinforcement ribs of the art tend to be separate elements which are screwed to or otherwise fastened to a planar element. These require extra labor and materials to fabricate. In addition, they may fail more easily than a rib which is an integral part of the device itself which cannot be separated from the base as it is part thereof.

Thermoform processes are also particularly useful for forming wheel wells into the single piece base member. A ridge which protrudes from the surface on either side of a trough form a single wheel well which supports an axle positioned transversely with respect to the longitudinal direction of the rib and trough. Each ridge is formed of two thicknesses of base material. Two of such wheel wells may be formed about a single transverse axis.

In addition, the ridge of a wheel well may be integrated together with a reinforcement rib which runs substantially the length of a base portion such as the back. In this way, strong forces incident on the wheels get absorbed by the rib and distributed over a maximal surface region of the base.

Another feature of the base member includes a standing pad element. In order to provide the bag with means of standing upright, a three point stand is formed by a simple bump pad in the surface which extends downwardly from the bottom portion. The bump being arranged symmetrically between the wheels but displaced from their axis cooperates with the wheels as the third point of a three point stand. The wheels form each of the other two points. The wheels being free to roll tend to cause the stand to be unstable and free to move. However, the third point provides high friction contact with a floor on which it sets thereby preventing advancement of the bag via the wheels.

Finally, another feature included in the thermo-formed base member is a surface relief pattern. The pattern may support indicia of text or design which may carry a trademark for identification purposes or possibly aesthetic design.

The bag member may be described in detail as follows. It may be preferably formed by sewing together several sections of flexible cloth material. The bag member is preferably comprised of three sections. A top section, a bottom section and a body section are sewn together to form an enclosure. The body section is preferably comprised of a single, continuous piece of material without seams. Two edges form mating edges and are joined together as the single piece body is rolled about a longitudinal axis to form a cylindrical shape. The upper portion of the body may be tapered in some versions. So formed, the top and bottom sections may be positioned orthogonal to the cylindrical axis and sewn to the bottom and top edges respectively of the body section thus forming an enclosure.

The bag member includes an opening along its length which may be secured by a zipper or Velcro type fasteners. As such, the edges of the single piece are said to be joined together as mates in accordance with the fastener type. For this disclosure, the opening is said to be on the "front side" of the bag member.

The bottom of the bag member, at its backside, may be fastened to the base member. This may be accomplished with rivet type fasteners which may be additionally supported by adhesives or sewing. A small hole may be drilled or punched through the flexible material of the bag and through the rigid material of the base at corresponding positions. A rivet inserted and affixed in the hole, holds the bag firmly to the base.

Travel bags of the invention may be used to carry sporting equipment such as golf gear. Since golf is a highly visible sport covered extensively by the media, sponsors of the sport enjoy having their names and trademarks prominently displayed on equipment. Therefore, the sides of the bag may support the application of indicia such as a silk-screened logo. Alternatively, a logo may be sewn, embroidered, or otherwise affixed to the sides of the bag.

In order that one may be able to move and manipulate the travel bag, specialized handles are arranged. These handles are placed in the front of the bag and at the top section of the bag. The handles may be a simple strap affixed at two ends to the bag. A plurality of rivets may be used in conjunction with sewing and adhesives to form a bond.

On the front of the bag, two handles, one on either side of the zippered opening and parallel thereto, operate together. They are positioned so that they may easily be grabbed together as one. A single handle, again a strap fastened at two ends, forms a top handle. The top handle is particularly useful for pulling the bag along on its wheels whereby the bag follows behind a person pulling it.

Travel bags of the art have sometimes provided large boxy pockets sewn to the outside surface of the bag. These are generally used to store bulky items such as shoes. These pockets tend to become caught upon sharp objects and be torn away from the bag. To remedy this problem, travel bags of the invention provide a new pocket design. A pleated arrangement allows pocket edges to be sewn flush to the outside surface of the bag. The pleats allow the pocket to expand outward while allowing the edges to remain attached flush. The pocket may be simple rectangular with four edges. A zipper opening may be formed near one edge, preferably a longer edge. To create a balanced bag, two pockets may be formed. One each being sewn to the bag symmetrically placed about the bag opening forms a balanced bag.

A special taper and padding arrangement may be configured to restrain objects in the top of the bag. It is sometimes desirable to prevent objects from freely moving about inside the bag enclosure. The objects may tend to bang together and perhaps may be damaged from such banging. Therefore, to provide restraint for items in the top of the bag, the top is formed with a taper. The girth of the bag is wider everywhere in comparison to the top-most portion of the bag. In addition, a padding is affixed onto the inner surface of the bag. Finally, a strap is employed about the taper section to cinch down on the objects and padding to form secure containment whereby objects will not easily move about the top section of the bag.

Because travel bags may be subject to extreme stress due to overpacking, travel bags of the invention include a specialized system of webbing. Webbing is affixed, by sewing or gluing for example, to the exterior surface of the bag member. Webbing is arranged in two general configurations. For strength along the length of the bag, longitudinal strips may be attached. For strength against radial expansion, or strength to resist bursting, webbing is provided about an axial configuration.

A strap may form a closed loop when two ends are coupled by a buckle having mating portions. Such closed loop configuration may additionally be provided an adjustment means so that the straps may be cinched down after a bag has been packed thus holding contents securely in place. In the longitudinal direction or about the length of the bag, a webbing may be attached at the top section of the bag running across the body and having a second end affixed at the bottom section of the bag. Two strips placed on the front side of the bag on either side of a zipper which otherwise vulnerable to bursting pressure.

Two handles may be formed to cooperate with longitudinal webbing pieces, each attached to either piece of the webbing. When the handles are brought together and held or joined as one, the bag may be grabbed so that the weight of its contents act on the webbing but not on the zipper. The handles ends may directly be fastened to the webbing via rugged fasteners such as rivets. Strong forces pulling on the handles are transmitted along the length of the bag via the webbing.

Two longitudinal strips may additionally be affixed to the surface of the back at the backside. These two webbing strips may form a loop at the top portion. The loop may be held or joined to a handle. The top handle may be affixed on its two ends to the top section of the bag. When the loop and top handle are grabbed together, strong pulling forces are transmitted along the webbing and provide relief to the bag which may otherwise suffer from vigorous pulling on the handle.

Webbing may be arranged about the circumference of the bag at any or at various places. Circumferal webbing forms a closed loop configuration which may be opened via a buckle. Buckles attached to the webbing may be placed at the zippered opening and opened and closed to allow easy access to the enclosed portion of the bag. Circumferal webbing is arranged to provide strength against bursting and adds support to the bag opening. As great stress tends to break zippers on some bags, the circumferal reinforcement is designed to resist bursting pressure at the zipper. The buckled straps will hold tight the load in the bag and allow the zipper to operate to open and close the bag without being damaged from heavily loaded bags. Additionally, the webbing which forms a closed loop may be arranged to hold down the edges of an accessory pocket.

The webbing not only cooperates with the bag member, but it additionally cooperates with the base member. To further transmit pulling forces to the strongest portion of the travel bag, the webbing strips may be riveted to the base. Webbing is first attached to the bag member and then the bag and webbing assembly is attached to the base member. A hole may be punched through the center of the webbing, through the bag material, and through the base member. A rivet binds the three together to form a very strong joint. A plurality of such rivet joints may be formed at various places where the bag, webbing and base may be collocated.

Webbing may also be arranged to cooperate with the accessory pockets. The edges of the pockets sewn to the surface of the body section of the bag, may be covered and additionally secured by webbing. Particularly along the edge of the pocket closest to the bag zipper opening. Additionally, the two edges lateral edges of the pockets may be sewn under axial webbing straps. With three of four edges sewn under webbing, the pockets may be stuffed quite full and still withstand the load. Additionally, they will be protected at their edges from objects which tend to tear and damage pockets sewn to the outside of typical travel bags.

The accessory pockets have openings which may be closed with zippers. The zippers may be placed in close proximity to the webbing so that most of the load is taken by the webbing. A zipper placed from about 0.5 inches to 1.5 inches allows full access to the pockets while providing security for the pocket.

Finally the webbing is arranged to cooperate with a 'D'-ring at the top of the bag. A 'D'-ring affixed to the webbing provides a strong element from which to hang or clip objects to. A garment bag may lay secure and substantially flat onto the front of the travel bag if it is clipped to the 'D'-ring.

I claim:

1. A travel bag comprising:

a base member, said base member being formed of rigid material to comprise a bottom, back and side portions each coupled to the other at curved joints to form a partially enclosed space operable to receive a bag member;

said bag member affixed to said base member, said bag member being formed of flexible, durable material to comprise a top, bottom and body section, the body section being formed of a single piece of material having two mating edges, the material arranged about a longitudinal axis, one mating edge of the single piece of material being joined to the second mating edge to form a generally cylindrical shape, the top section being arranged in a plane substantially perpendicular to a cylinder axis further being affixed to the body section, the bottom section being arranged in a plane substantially perpendicular to the cylinder axis;

webbing reinforcement, the webbing being affixed to said bag member and further affixed to said base member whereby tension and tearing forces are transmitted from said bag member to said base member and are resisted by said webbing, said webbing comprising a configuration being along a longitudinal direction from said bag member top section to said bag member bottom section; and a handle connected to said webbing reinforcement.

2. A travel bag according to claim 1 wherein said webbing reinforcement comprises a longitudinal piece affixed to the back portion of said bag member thereby forming a loop at the top, whereby pulling on said loop transmits tension forces along said longitudinal webbing pieces.

3. A travel bag according to claim 2 further comprising a top handle having two ends each affixed to the top section of the bag member wherein said handle is removably coupled to said loop.

4. A travel bag according to claim 1 further comprising a top handle having two ends each affixed to the top section of said bag member.

5. A travel bag according to claim 1 further comprising a stand member coupled to the bottom portion of the base member.

6. A travel bag according to claim 1 further comprising a top handle having two ends each affixed to the body section of the bag member.

7. A travel bag according to claim 1 further comprising at least one wheel coupled to the base member bottom portion.

8. A travel bag comprising:

a base member, said base member being formed of rigid material to comprise a bottom, back and side portions each coupled to the other at curved joints to form a partially enclosed space operable to receive a bag member;

a bag member affixed to said base member, said bag member being formed of flexible, durable material to comprise a top, bottom and body section, the body section being formed of a single piece of material having two mating edges at a bag opening, the material arranged about a longitudinal axis, one mating edge of the single piece of material being joined to the second mating edge to form a generally cylindrical shape, the top section being arranged in a plane substantially perpendicular to a cylinder axis further being affixed to the body section, the bottom section being arranged in a plane substantially perpendicular to the cylinder axis;

webbing reinforcement affixed to said bag member; and, an accessory pocket comprised of a single layer top in a pleated configuration having four edges which substantially form a rectangular periphery affixed to an exterior of said travel bag, said four edges being affixed flush to an exterior surface of said bag member.

9. A travel bag according to claim 8 wherein two of the four edges of said pocket are affixed to two circumferential webbing pieces whereby said webbing pieces reinforces and holds the pocket edges flush with the exterior of said bag member.

10. A travel bag according to claim 8 further comprising a second pocket symmetrically positioned about the bag opening whereby the travel bag having loaded pockets is balanced with respect to weight and bulk.

11. A travel bag according to claim 8 further comprising a stand member coupled to the bottom portion of the base member.

12. A travel bag according to claim 8 further comprising a handle positioned at the top section of the bag member having two ends each affixed to the body section of the bag member.

13. A travel bag according to claim 8 further comprising at least one wheel coupled to the base member bottom portion.

14. A travel bag comprising:

a. a base member, said base member being formed of rigid material to comprise a bottom, back and side portions each coupled to the other at curved joints to form a partially enclosed space operable to receive a bag member;

b. said bag member affixed to said base member, said bag member being formed of flexible, durable material to comprise a top, bottom and body section, the body section being formed of a single piece of material having two mating edges at a bag opening, the material arranged about a longitudinal axis, one mating edge of the single piece of material being joined to the second mating edge to form a generally cylindrical shape, the top section being arranged in a plane substantially perpendicular to a cylinder axis further being affixed to the body section, the bottom section being arranged in a plane substantially perpendicular to the cylinder axis; and c. webbing reinforcement, the webbing being affixed to said bag member and further affixed to said base member whereby tension and tearing forces are transmitted from said bag member to said base member and are resisted by said webbing, said webbing comprising a first configuration being along a longitudinal direction from said bag member top section to said bag member bottom section, and a second configuration located about the circumference of the bag member.

15. A travel bag of claim 14, said first configuration of webbing comprising four longitudinal pieces, two of the longitudinal pieces being affixed one to either side of the mating edges which form said bag opening at a front side, and two of the longitudinal pieces affixed to a back side of said bag member.

16. A travel bag of claim 15, wherein said two longitudinal pieces of webbing affixed to said back portion being joined together to form a loop at the top section of the bag member, whereby pulling on said loop transmits tension forces along longitudinal webbing pieces.

17. A travel bag according to claim 15 further comprising at least one front handle affixed to the front side longitudinal pieces such that tension forces are transmitted along the webbing pieces.

18. A travel bag according to claim 14 wherein said second configuration of webbing comprises a closed loop configuration about the circumference of said bag member.

19. A travel bag according to claim 18 wherein said closed loop configuration about the circumference of said bag member comprises two circumferential pieces being affixed to said bag member in two different planes perpendicular to the axis.

20. A travel bag according to claim 14 further comprising a stand member coupled to the bottom portion of the base member.

21. A travel bag according to claim 14 further comprising a handle positioned at the top section of the bag member having two ends each affixed to the body section of the bag member.

22. A travel bag according to claim 14 further comprising at least one wheel coupled to the base member bottom portion.

23. A travel bag comprising:

a base member, said base member being formed of a rigid material having a bottom, back and side portions each coupled to the other at curved joints to form a partially enclosed space operable to receive a bag member;

said bag member affixed to said base member, said bag member being formed of flexible, durable material having a top, bottom and body section, the body section being formed of a single piece of material having a bag member opening, the material arranged about a longitudinal axis to form a generally cylindrical shape, the top section being arranged in a plane substantially perpendicular to a cylinder axis further being affixed to the body section, the bottom section being arranged in a plane substantially perpendicular to the cylinder axis; and webbing reinforcement, the webbing being affixed to said bag member whereby tension and tearing forces are resisted by said webbing, said webbing comprising a first configuration being along a longitudinal direction from said bag member top section to said bag member bottom section.

24. A travel bag according to claim 23 wherein said first configuration having a longitudinal webbing piece being configured to form a loop at the top section of the bag member, whereby pulling on said loop transmits tension forces along the longitudinal webbing piece.

25. A travel bag according to claim 24 further comprising a handle coupled to the top section of the bag member wherein said handle is removably coupled to said loop.

26. A travel bag according to claim 24 further comprising a handle positioned at the top section of the bag member having two ends each affixed to the top section of the bag member.

27. A travel bag according to claim 26 wherein said handle is removably coupled to said loop.

28. A travel bag according to claim 23 further comprising a handle connected to said webbing reinforcement.

29. A travel bag according to claim 23 wherein the webbing further comprises a second configuration located about the circumference of the bag member.

30. A travel bag according to claim 29 wherein said second configuration of webbing comprises a loop configuration about the circumference of said bag member.

31. A travel bag according to claim 30 wherein said loop configuration about the circumference of said bag member comprises two circumferential pieces being affixed to said bag member in two different planes perpendicular to the cylinder axis.

32. A travel bag according to claim 23 wherein the first configuration further comprises two longitudinal webbing pieces being affixed one to either side of the bag member opening at a front side.

33. A travel bag according to claim 32 further comprising at least one front handle affixed to the longitudinal webbing pieces on either side of the bag member opening such that tension forces are transmitted along the webbing pieces.

34. A travel bag according to claim 23 further comprising a stand member coupled to the bottom portion of the base member.

35. A travel bag according to claim 23 further comprising a handle positioned at the top section of the bag member having two ends each affixed to the body section.

36. A travel bag according to claim 23 wherein said bag member opening is secured with at least one zipper.

37. A travel bag according to claim 23 wherein said base member further comprises at least one wheel positioned at the bottom portion.

38. A travel bag, comprising:

a bag member being formed of flexible, durable material having a top, bottom and body section, the body section being formed of a single piece of material having a bag opening, the material arranged about a longitudinal axis, to form a generally cylindrical shape, the top section being arranged in a plane substantially perpendicular to a cylinder axis further being affixed to the body section, the bottom section being arranged in a plane substantially perpendicular to the cylinder axis; and webbing reinforcement, the webbing reinforcement being affixed to an exterior of said bag member whereby tension and tearing forces are resisted by said webbing reinforcement, said webbing reinforcement having a first configuration being along a longitudinal direction from said bag member top section to said bag member bottom section.

39. A travel bag according to claim 38 wherein said first configuration has a first longitudinal webbing piece affixed to a back side configured to form a loop at the top section of the bag member.

40. A travel bag according to claim 39 further comprising a handle positioned at the top section of the bag member having two ends each end affixed to the body section, wherein said handle is removably coupled to the loop.

41. A travel bag according to claim 39 further comprising a handle positioned at the top section of the bag member having two ends each end affixed to the top section of the bag member, wherein said handle is removably coupled to the loop.

42. A travel bag according to claim 38 further comprising a handle connected to said webbing reinforcement.

43. A travel bag according to claim 38 wherein the webbing reinforcement further comprises a second configuration located about the circumference of the bag member.

44. A travel bag according to claim 43 further comprising at least one handle affixed to the first configuration, wherein said first configuration is affixed to the second configuration such that tension forces are transmitted along the webbing reinforcement.

45. A travel bag according to claim 38 wherein the first configuration further comprises two longitudinal webbing pieces being affixed one to either side of the bag member opening at a front side.

46. A travel bag according to claim 45 further comprising at least one front handle affixed to the longitudinal webbing pieces on either side of the bag member opening such that tension forces are transmitted along the webbing pieces.

47. A travel bag according to claim 38 wherein said second configuration of webbing comprises a loop configuration about the circumference of said bag member.

48. A travel bag according to claim 47 wherein said loop configuration about the circumference of said bag member comprises two circumferential pieces being affixed to said bag member in two different planes perpendicular to the axis.

49. A travel bag according to claim 38 further comprising a base member, said base member being formed of a rigid material having a bottom, back and side portions each coupled to the other at curved joints to form a partially enclosed space operable to receive said bag member.

50. A travel bag according to claim 49 wherein said base member further comprises at least one wheel positioned at the bottom portion.

51. A travel bag according to claim 49 further comprising a stand member coupled to the bottom portion of the base member.

52. A travel bag according to claim 38 further comprising a handle positioned at the top section of the bag member having two ends each end affixed to the body section.

53. A travel bag according to claim 38 further comprising a handle positioned at the top section of the bag member having two ends each end affixed to the top section of the bag member.

54. A travel bag according to claim 38 wherein said bag member opening is secured with at least one zipper.

* * * * *